US009213268B2

(12) United States Patent
Voigt et al.

(10) Patent No.: US 9,213,268 B2
(45) Date of Patent: Dec. 15, 2015

(54) SYSTEMS AND METHODS FOR IMPLEMENTING A RESEALABLE SELF-ALIGNING MAGNETIC SEAL IN AN IMAGE FORMING DEVICE

(71) Applicant: XEROX Corporation, Norwalk, CT (US)

(72) Inventors: David Voigt, Webster, NY (US); Edward Savage, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/279,373

(22) Filed: May 16, 2014

(65) Prior Publication Data

US 2015/0331361 A1 Nov. 19, 2015

(51) Int. Cl.
*G03G 15/08* (2006.01)

(52) U.S. Cl.
CPC ..... *G03G 15/0898* (2013.01)

(58) Field of Classification Search
CPC ..... G03G 15/0898
USPC ..... 399/102, 103, 104, 105, 106, 258, 262, 399/120
See application file for complete search history.

(56) References Cited

U.S. PATENT DOCUMENTS

| | | | | | |
|---|---|---|---|---|---|
| 5,260,749 | A * | 11/1993 | Yahata | 399/106 |
| 5,267,003 | A * | 11/1993 | Grappiolo | 399/109 |
| 5,442,423 | A * | 8/1995 | Edmunds et al. | 399/262 |
| 5,564,607 | A | 10/1996 | Miller et al. | |
| 5,742,875 | A | 4/1998 | Bogoshian et al. | |
| 6,719,768 | B1 * | 4/2004 | Cole et al. | 606/153 |
| 6,993,265 | B2 * | 1/2006 | Morgan | 399/106 |
| 2004/0223780 | A1 | 11/2004 | Thompson et al. | |

* cited by examiner

*Primary Examiner* — Sophia S Chen
(74) *Attorney, Agent, or Firm* — Ronald E. Prass, Jr.; Prass LLP

(57) ABSTRACT

A system and method are provided employing an improved re-sealable self-aligning sliding magnetic seal system comprising two cooperating parts. A first of two cooperating parts of the magnetic toner seal is configured with a foam base or support component attached to one material transport component. The foam base or support component has a thin flexible magnet layer formed or fixed on top of a portion that faces another material transport component in operation. A second of two cooperating parts of the magnetic toner seal may is configured as a corresponding thin flexible magnet layer attached directly to the another material transport component. The thin flexible magnet layers are cut so that the magnetic poles line up when the material transport components to which the two cooperating parts are attached are aligned. The disclosed configuration support making the two cooperating parts of the toner seal generally self-aligning.

18 Claims, 3 Drawing Sheets

SYSTEMS AND METHODS FOR IMPLEMENTING A RESEALABLE SELF-ALIGNING MAGNETIC SEAL IN AN IMAGE FORMING DEVICE

BACKGROUND

1. Field of Disclosed Subject Matter

This disclosure relates to systems and methods for providing an improved re-sealable self-aligning sliding magnetic seal system, including for use in image forming systems and xerographic image forming systems.

2. Related Art

Virtually all classes and types of image forming devices and/or systems include one or more customer replaceable components or units (commonly referred to as "CRUs"). Many of these CRUs are routinely replaceable based on an indication of an end of service life condition for the CRUs, or exhaustion of consumable products, such as ink and toner, packaged in the CRUs. The service life of a particular CRU, or the consumable product level in the CRU, can be tracked and measured, for example, according to a number of image forming operations that the CRU may undertake. For the purposes of this disclosure, the terms of CRU and consumable may be used interchangeably.

Marking materials for marking image receiving media substrates, including, for example, charged toner particles for use in electrostatographic and xerographic image forming devices, are provided in source CRUs, including toner bottles or reservoirs, that are configured to afford convenience to the user in replacing the toner. Further, there are myriad transporting or translating components between the toner source and the components on which a toner image is formed for transfer to an image receiving media substrate. The objective of customer convenience in easily replacing any of these components, without reliance on manufacturer or supplier service personnel, may introduce other concerns in a marking material supply path between a CRU marking material source and an ultimate marking material delivery system for depositing the marking material on, for example, an intermediate transfer body, or ultimately on a substrate.

Difficulties arise, for example, where myriad intermediate customer replaceable components, each with a specific configuration, may be positioned between the CRU marking material source and the ultimate marking material delivery system in the image forming device. At each interface between individual components, it is important to seal the marking material supply path. Migration of, for example, charged toner particles outside of the marking material supply path between the CRU marking material source and the ultimate marking material delivery system can disadvantageously affect operation of the image forming device. When image forming device operation is adversely affected, service personnel from the manufacturer or supplier of the image forming device may need to be contacted in an effort to clean interior surfaces of the image forming device that are not intended to be cleaned by customers.

Based on the above, it is recognized that it is important to provide a generally securely closed marking material supply path, particularly between individual components that are movable and/or removable with respect to each other, for toner transport throughout the image forming system. This may be accomplished by providing positive sealing, using certain sealing components, between certain non-stationary mating parts associated with the movable and/or removable components, including those associated with customer replaceable components, in a marking material supply path in an image forming system. Specifically, at each interface between any non-stationary mating part in the image forming system, particularly those used to transport charged toner particles from a marking material source to the ultimate marking material delivery system, it is important to provide some positive mechanical seal at the each interface.

Conventionally, the positive mechanical seal has been comprised of a thick-foam sealing component for providing a pressure based sealing between cooperating openings in multiple mechanical components. Routinely, the thick foam seal is slightly oversized to the gap between the ultimate positions of the cooperating components, and the openings between those cooperating components in their final or home positions, i.e., once those cooperating components are finally operationally mounted in the image forming device. Foam materials, often covered with mylar or similar thin-film plastics, then provide a flange surrounding the cooperating openings in adjacent mechanical cooperating components in order to attempt to provide a closed supply path for marking material translated along the process path between the individual cooperating components. Simply put, the compressible foam fills the gap, while the mylar or other similar thin-film plastic provides a sliding surface to protect the foam. Difficulties with such a design include that, by nature, the conventional thick foam seals must be deformed in some manner during installation of the components to which they are attached, and when the components are in their operating positions, the thick foam seals only operated effectively by maintaining an opposing force between the cooperating components between which the thick foam seals are placed.

Toner seals, such as those generically described above, positioned, for example, between a developer housing and a duct assembly in electrostatographic image forming device, may function adequately under normal operating conditions for the electrostatographic image forming device. The thus-configured toner seals may provide an adequate mechanical conduit for the translation of the charged toner particles along a flow path between cooperating components in a manner that fairly effectively contains translation of the toner particles between openings in separate cooperating components. Generally, these toner seals are attached with an adhesive to an opening in one or the other of the cooperating components. A specific example is where the toner seals are attached with an adhesive assembly to an opening on a top of a trickle duct assembly in a particular image forming device configuration. Such an opening may be designed to accept excess toner from a cooperating opening in, for example, a developer housing module during routine operations in the image forming system.

A configuration of these individual cooperating components may, however, define that one or the other of the components may be designed to transversely slide away from the other of the components to facilitate (1) individual cooperating component removal and replacement, or (2) access for maintenance or for other individual component removal and replacement requiring temporary removal of one of the other of the individual cooperating components.

Placement and mating of the individual internal components in the image forming device may not optimally provide for mating of individual cooperating openings in an orthogonal installation process along an axis of the individual openings that may result in simple compression of the thick foam seal between two cooperating faces. Rather, it is more often the conventional case where individual components are slid transversely to an orthogonal axis between the openings. Such mechanical motion between cooperating components tends to transversely deform the conventional thick foam seals as one or the other of the cooperating components is slid across a facing surface of the thick foam seal. Such motion may affect the operational integrity and/or efficiency of the thick foam seals. Any compromise of a mating capacity of a conventional thick foam seal based on, for example, sliding attachment motion between cooperating components, may eventually result in unacceptable damage to the seal, resulting in unacceptable toner/developer material leakage within the image forming system. As noted above, this toner material leakage may adversely affect image quality for the images produced by the image forming system, or may lead to random operating malfunctions or ultimately to an overall lifecycle degradation for the image forming system specifically attributable to the material leakage and internal system contamination.

SUMMARY OF DISCLOSED EMBODIMENTS

In view of the above conditions, it may be advantageous to provide an advanced sealing component that may adequately address certain of the shortfalls in the employment of conventional thick foam seals between cooperating devices.

Exemplary embodiments of the systems and methods according to this disclosure may provide a magnetic toner seal generally comprising two cooperating parts.

In embodiments, a first of the two cooperating parts of the magnetic toner seal may be configured with a foam base or support component, which may be similar to, but thinner than, the conventional thick foam seal. Instead of having a mylar or other plastic overcoat, the foam base or support component may have a thin flexible magnet layer on top of a portion that is intended to face the other of the two cooperating parts when components to which the two cooperating parts are attached are properly installed in their corresponding final positions. In the example discussed briefly above, the first of the two cooperating parts of the magnetic toner seal may be adhesively attached to the trickle duct in like manner to the attachment of the original thick foam seal.

In embodiments, a second of the two cooperating parts of the magnetic toner seal may be configured as a corresponding thin flexible magnet layer attached directly (again by adhesion, for example) to the other of the cooperating components to which the two cooperating parts are attached without the underlying foam base or support component. In the example discussed briefly above, the second of the two cooperating parts of the magnetic toner seal may be easily attached to the developer module.

Exemplary embodiments may provide that the two flat magnets, comprising the thin flexible magnet layers, may be cut so that the magnetic poles line up when the movable components to which the two cooperating parts are attached are aligned, e.g., the developer module may be moved to its home position. Such a configuration may support making the two cooperating parts of the toner seal generally self-aligning. Alternating magnetic poles may allow the magnets to 'jump' over each other when the developer housing is retracted. This action may result in lower sliding friction between the two cooperating parts of the magnetic toner seal during individual cooperating component removal and replacement.

In embodiments, an additional improvement in the reduction of sliding friction may be realized by applying a small amount of developer beads to at least one of the surfaces of the two flat magnets. The two flat magnets may hold them in place and allow the developer beads to act as ball bearings between the opposing surfaces of the two cooperating parts of the magnetic toner seal.

In embodiments, the magnetic attraction between the two cooperating parts of the magnetic toner seal may result in positive closure without the need for excessive interference caused by the relatively higher compression of a conventional thick foam seal layer.

Exemplary embodiments may provide for an increased lifecycle of the described magnetic toner seal based on the two flat magnets being more robust in their surface composition and particularly stronger than conventional mylar or other plastic film overlayers. Based on a transverse strength of the two flat magnets, they can be expected to avoid wrinkling as they are slid across one another and further may be configured with beveled edges in order that ease of sliding of the two parts of the magnetic toner seal may be better accommodated during installation of the cooperating components to which the two parts of the magnetic toner seal are individually attached.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for providing a re-sealable self-aligning sliding magnetic seal for use in an image forming device, including a xerographic image forming system, will be described, in detail, with reference to the following drawings, in which.

DETAILED DESCRIPTION OF THE DISCLOSED EMBODIMENTS

The systems and methods for providing a re-sealable self-aligning sliding magnetic seal system for use in an image forming device, including a xerographic image forming system, according to this disclosure will generally refer to this specific utility or function for those systems and methods. Exemplary embodiments described and depicted in this disclosure should not be interpreted as being specifically limited to any particular configuration of particular components, or limited to employment of those components in, for example, an image forming device. Any advantageous adaptation of cooperating components that are intended to have a transport flow path established therebetween for transferring material between the cooperating components and that may benefit from employment of the disclosed re-sealable self-aligning sliding magnetic seal system, particularly as a replacement to a conventional thick foam seal, is contemplated as being included in this disclosure.

Specific reference to, for example, any image forming device, or component within an image forming device, are intended to be illustrative only. While the disclosed embodiments will be described as being particularly adaptable to components comprising a transport path for charged magnetic toner particles in an image forming device, the mention of this particular adaptation is made for clarity and ease of understanding only and is not intended to be limiting to the disclosed subject matter, or the subject matter of the below-presented claims. The term "image forming device" or any other like term, as referenced throughout this disclosure, is intended to refer globally to a class of devices and systems that carry out what are generally understood as image forming and/or substrate marking functions as those functions would be familiar to those of skill in the art of image forming devices. Additionally, while references will generally be made to individual charged magnetic toner transport components, these references are intended to be exemplary only and not limiting to the disclosed subject matter.

Exemplary embodiments propose a unique re-sealable self-aligning sliding magnetic seal arrangement to replace thick foam seals for mating cooperating openings in multiple cooperating components to form transport path for certain materials between the multiple cooperating components. An advantage of the disclosed subject matter is an ability to replace conventional thick foam seals with a sealing capacity that is more robust, i.e., able to withstand further cycles of removal and replacement of one or more of the multiple cooperating components, without adversely affecting the sealing capacity of the improved seals.

Figure 1:
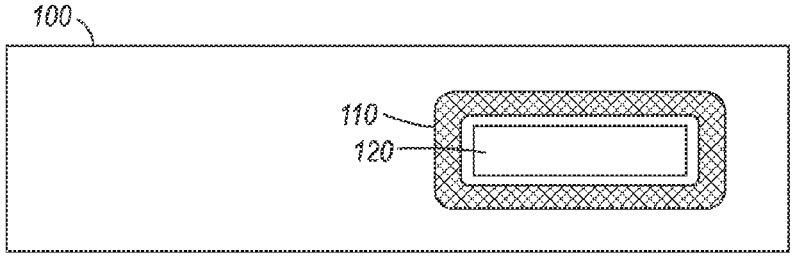
FIG. 1 Related Art
FIG. 1 illustrates a schematic representation of a cooperating component having a conventional thick foam seal.
Figure 2:
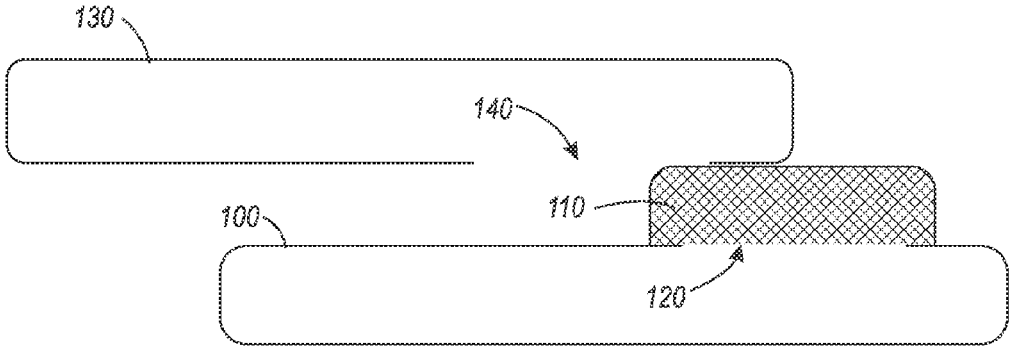
FIG. 2 Related Art
FIG. 2 illustrates a schematic representation of a pair of cooperating components being slid together for positioning of relative openings in a vicinity of a conventional thick foam seal.
Figure 3:
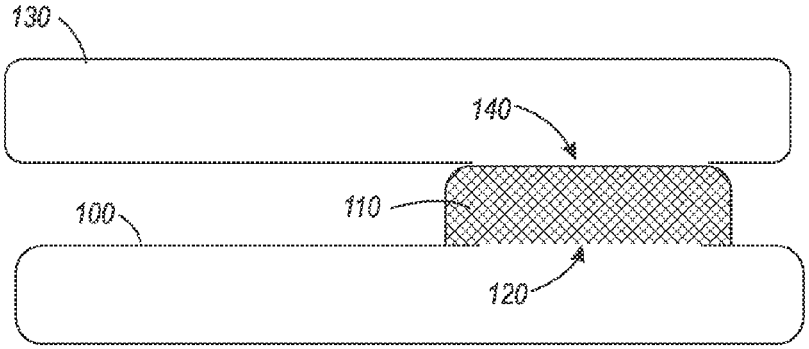
FIG. 3 Related Art
FIG. 3 illustrates a schematic representation of a pair of cooperating components in their final operating position with the conventional thick foam seal forming a conduit between openings in the pair of cooperating components.

For a frame of reference, FIGS. 1-3 are presented to show employment of a conventional thick foam seal. FIG. 1 illustrates a schematic representation of a cooperating component 100 having a material passage opening 120 through which material is intended to pass. The cooperating component 100 may have formed or fixed on an outer surface a conventional thick foam seal 110. The conventional thick foam seal 110 may be comprised of some malleable foam material and may separately be covered with mylar or a similar thin-film plastic to protect the foam material and allow sliding engagement of other components without adversely affecting the integrity of the foam material.

As is mentioned briefly above, separate cooperating components may be slidably engaged to one another to align material passage openings therein to provide a transport path for material between the separate cooperating components. FIG. 2 illustrates a schematic representation of a pair of separate cooperating components 100,130 being slid together for positioning of relative material passage openings 120,140 in a vicinity of a conventional thick foam seal 110. FIG. 3 then illustrates a schematic representation of the pair of separate cooperating components 100,130 in their final operating position with the conventional thick foam seal 110 forming a conduit for flow of material between the relative material passage openings 120,140 in the pair of separate cooperating components 100,130. A particular example for use in image forming device may include a trickle duct assembly that may be designed to accept excess toner from a material passage opening in a developer housing module during operation. To facilitate removal and replacement of either of these separate cooperating components 100,130, or other cooperating components in a vicinity of these separate cooperating components, numerous occurrences of sliding engagement of the pair of separate cooperating components 100,130 may ultimately affect and integrity of the thick foam seal 110 resulting in leakage of material, including, for example, developer/toner material in an image forming device, to a surrounding area thereby causing contamination of that surrounding area in the image forming device.

Figure 4:
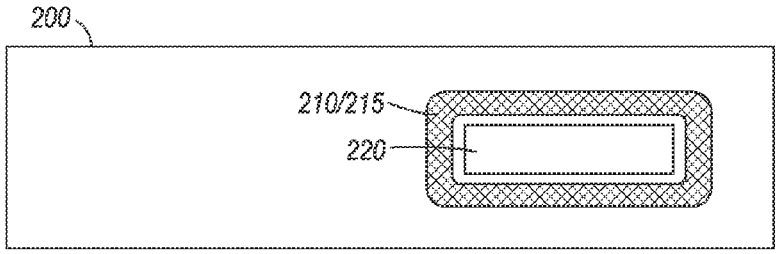
FIG. 4 illustrates a schematic representation of a cooperating component having an improved sliding magnetic seal according to this disclosure.

The disclosed embodiments are directed to a re-sealable self-aligning sliding magnetic seal component comprising at least two parts. FIG. 4 illustrates a schematic representation of a first cooperating component 200 having an improved sliding magnetic seal system according to this disclosure. As shown in FIG. 4, the first cooperating component 200 may have a material passage opening 220 in at least one outer surface of the first cooperating component 200. The disclosed embodiments are directed to an improved sliding magnetic seal system comprising at least two cooperating parts. A first of the at least two cooperating parts 210/215 is schematically represented in FIG. 4 surrounding the material passage opening 220 in a like manner to the conventional thick foam seal shown in FIG. 1. This first of the at least two cooperating parts comprising the improved sliding magnetic seal system may be formed on, or otherwise affixed to, the outer surface of the first cooperating component 200.

Figure 5:
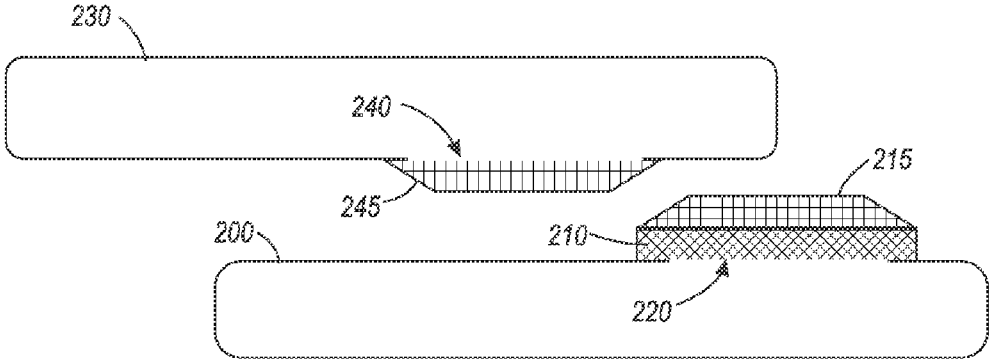
FIG. 5 illustrates a schematic representation of a pair of cooperating components being slid together for positioning of relative openings in a vicinity of an improved sliding magnetic seal according to this disclosure.

FIG. 5 illustrates a schematic representation of a pair of cooperating components 200,230 being slid together for positioning of relative material passage openings 220,240 in a vicinity of an improved sliding magnetic seal system. As is shown in greater detail in FIG. 5, the first of the at least two cooperating parts of the improved sliding magnetic seal system may include a foam base layer component 210 similar to, but thinner than, a conventional thick foam seal. Further, instead of a mylar or other thin-film plastic overlayer, a first thin flexible magnet layer 215 may be positioned on a surface of the foam base layer component 210 facing the other of the cooperating components 230. This first of the at least two cooperating parts of the improved sliding magnetic seal system may be, for example, formed on, or affixed to, a trickle duct again in a manner similar to the installation of the conventional thick foam seal.

A second of the at least two cooperating parts of the improved sliding magnetic seal system may be formed only of a second thin flexible magnet layer 245 surrounding a material passage opening 240 on the second of the cooperating components 230, which, as indicated above, may be a developer module. As shown in FIG. 5, the second thin flexible magnet layer 245 may be mounted directly to the outer surface of the second of the cooperating components 230 with no intervening foam base layer component.

Figure 6:
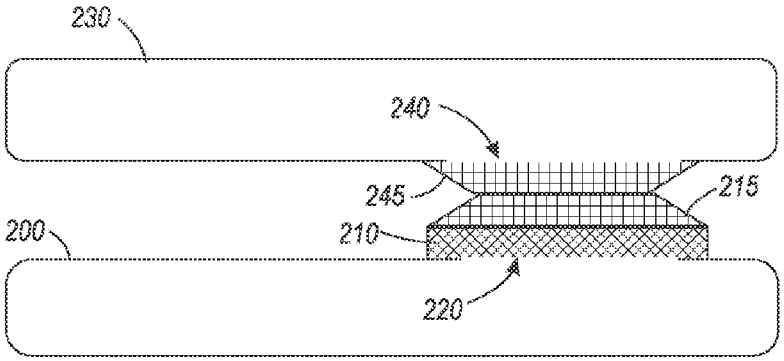
FIG. 6 illustrates a schematic representation of a pair of cooperating components in their final operating position with the improved sliding magnetic seal forming a conduit between openings in the pair of cooperating components according to this disclosure.
Figure 7:
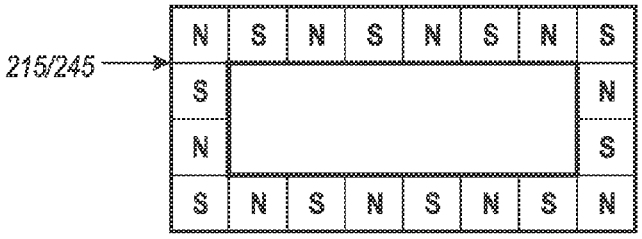
FIG. 7 illustrates an exemplary thin film magnetic layer with alternating poles according to this disclosure.

The first and second thin flexible magnet layers 215,245 may be cut so that individual magnetic poles (see FIG. 7) line up when the first and second of the at least two cooperating components 200,230 are assembled in their final (home) positions. This configuration will tend to make the first and second thin flexible magnet layers 215,245 self aligning relative to one another. Alternating magnetic poles (see FIG. 7) allow the magnets to 'jump' over each other when the first and second of the cooperating components 200,230 are moved relative to one another, e.g., when a developer housing is positioned or retracted relative to a trickle duct. This physical interaction results in a lower sliding friction between the first and second thin flexible magnet layers 215,245. FIG. 6 illustrates a schematic representation of the pair of cooperating components 200,230 in their final operating position with the improved sliding magnetic seal system forming a conduit between the relative material passage openings 220,240 in the pair of cooperating components 200,230.

An additional improvement in sliding friction may be realized by applying a small amount of developer beads to surfaces of the first and second thin flexible magnet layers 215, 245. The first and second thin flexible magnet layers 215,245 may hold them in place and the amount of developer beads may act like ball bearings between the surfaces of the first and second thin flexible magnet layers 215,245. The magnetic attraction between the first and second thin flexible magnet layers 215, 245 of the improved sliding magnetic seal system may result in positive closure without the need for excessive interference caused by high compression of the conventional thick foam seal layer. The first and second thin flexible magnet layers 215,245 may be stronger than the mylar or other thin-film plastic overlayer in that the first and second thin flexible magnet layers 215,245 will tend neither to wrinkle nor to tear during sliding engagement of the first and second thin film flexible magnet layers 215,245 as the pair of cooperating components 200,230, to which the first and second thin film flexible magnet layers 215,245 are affixed, are positioned relative to one another.

An additional advantage may be realized in that at least one edge of one or both of the first and second thin flexible magnet layers 215,245 may be formed with beveled edges to promote easier initial engagement between the separate components of the improved sliding magnetic seal system.

In experimentation, a number of thin flexible magnet samples were obtained and tested to optimize certain design factors. Design factors that were determined to have certain significance included spacing of alternating magnetic poles, alignment of alternating magnetic poles between each of the first and second thin film flexible magnet layers comprising the improved sliding magnetic seal system, magnetic strength, overall surface area of the facing magnetic seal components, a degree of movement of the foam base layer or spacer, and a size of the material passage openings forming the material passage between a pair of cooperating components. In a specific embodiment, design responses included installation and positioning of a developer housing and baffle in an image forming device (design for manufacturing and design for field repair) and once installed, sliding friction, seal leakage, and durability under actual usage.

A principal advantage of the disclosed improved magnetic sliding seal system may be realized in reliability. Other improvements are the self-alignment feature and reduced sliding friction. Mating assemblies that periodically must be disengaged from each other and then reengaged may find advantage in that the improved sliding magnetic seal system may seal against very small magnetic particles migrating past the seal. The physical configuration may be self aligning, and have low sliding friction, low cost, high reliability and an improved design for manufacturing and/or repair. Embodiments may be usable in myriad connection scenarios and applications including between tubes, baffles, chutes and/or other assemblies that are commonly connected together for the transport of material, including toner/carrier/developer materials in a xerographic engine. The self alignment feature may prove particularly valuable in small areas where it may be difficult to positively locate or match mating assemblies such as small tubes or translating parts. The low sliding friction feature reduces torque on assemblies that must be disengaged and reengaged. The jumping' that is felt during assembly caused by alternate poles moving over each other may be used to provide positive feedback that the seal may be correctly positioned by counting a number of jumps felt during installation.

Figure 8:
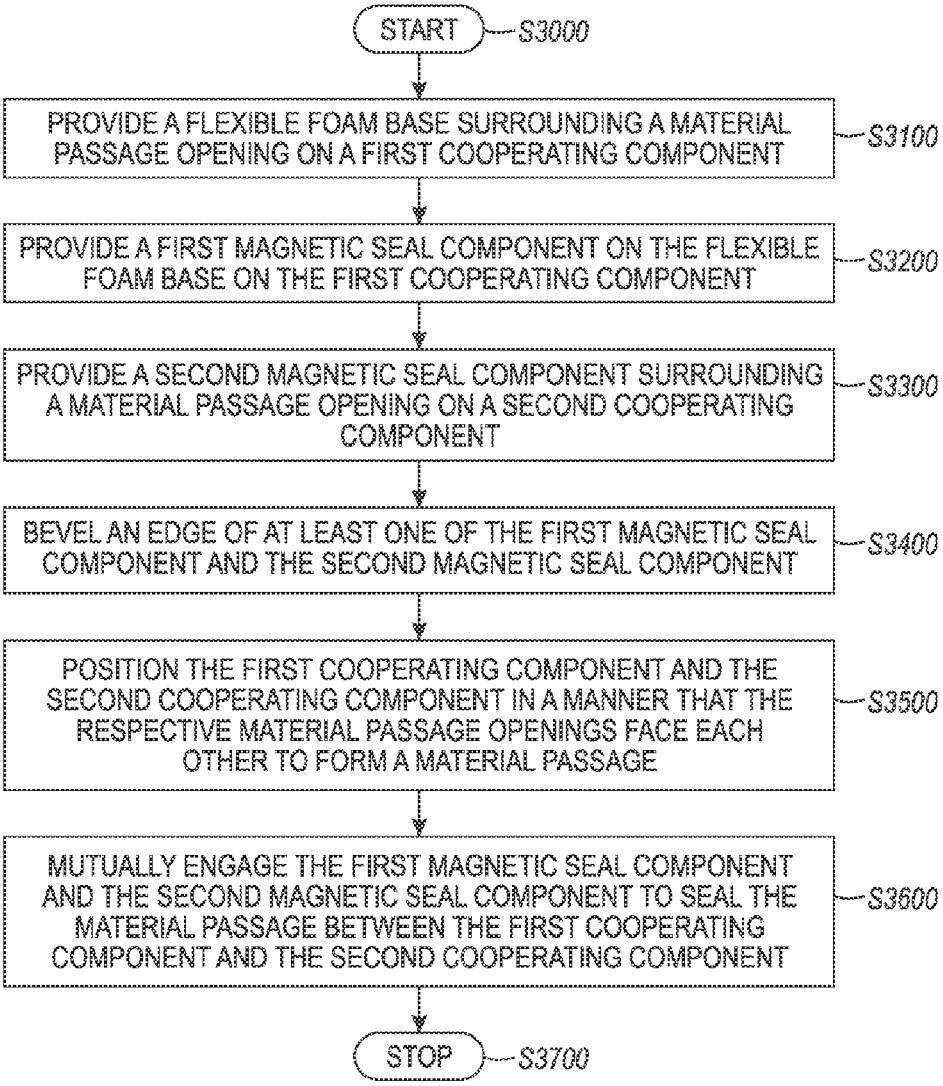
FIG. 8 illustrates a flowchart of an exemplary method for employing the improved sliding magnetic seal according to this disclosure.

The disclosed embodiments may include an exemplary method for employing an improved sliding magnetic seal system. FIG. 8 illustrates a flowchart of such an exemplary method. As shown in FIG. 8, operation of the method commences at Step S3000 and proceeds to Step S3100.

In Step S3100, a comparatively thinner flexible foam base component may be provided surrounding a material passage opening on a first cooperating component. Operation of the method proceeds to Step S3200.

In Step S3200, a first magnetic seal component may be provided on the flexible foam base on the first cooperating component. The first magnetic seal component may be provided on a surface of the flexible foam base facing a second cooperating component in operation. Operation of the method proceeds to Step S3300.

In Step S3300, a second magnetic seal component may be provided surrounding a material passage opening on a second cooperating component. Operation of the method proceeds to Step S3400.

In Step S3400, at least one edge of one of the first magnetic seal component and the second magnetic seal component may be beveled in an effort to facilitate sliding interaction between the first magnetic seal component and the second magnetic seal component at a point of initial physical interaction. Operation of the method proceeds to Step S3500.

In Step S3500, the first cooperating component second cooperating component may be positioned in a manner that the respective material passage openings face each other to form a material passage. This positioning may be from any direction including a direction transverse to the material passage requiring sliding interaction between the first megapixel component and the second megapixel component. Operation the method proceeds to Step S3600.

In Step S3600, the first magnetic component and the second magnetic component may mutually engage one another when the first cooperating component and the second cooperating component are finally positioned in their operating positions and aligned in the manner described in Step S3500. This mutual engagement may form a positive magnetic seal to generally avoid leakage outside the material passage. Operation the method proceeds to Step S3700, where operation of the method ceases.

The above-described exemplary systems and methods may reference certain conventional image forming device components to provide a brief, background description of image forming means that may be modified to include the disclosed sliding re-sealable magnetic components forming an improved magnetic seal system for ease of understanding of the disclosed subject matter. No particular limitation to a specific configuration of the individual image forming device components, or any limitation on improved magnetic seal system installation is to be construed based on the description of the exemplary elements depicted and described above.

Those skilled in the art will appreciate that other embodiments of the disclosed subject matter may be practiced with many types of image forming and/or material transport elements in systems of many different configurations. As mentioned briefly above, experimental magnetic sealing components have taken on numerous different configurations. The disclosed systems and methods are directed to a broad configuration of such sealing components and are not intended to imply any potentially limiting configuration based on the above description and the accompanying drawings.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 8, and the accompanying description, except where a particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to this disclosure.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A sealing element, comprising:

a first sealing component attached to a first cooperating component surrounding a material passage opening in the first cooperating component, the first sealing component comprising a first magnetic layer; and a second sealing component attached to a second cooperating component surrounding a material passage opening in the second cooperating component, the second sealing component comprising a second magnetic layer, the first magnetic layer and the second magnetic layer each comprising a plurality of magnetic poles that are aligned to form a magnetically sealed material passage in a form of a conduit between the material passage opening of the first cooperating component and the material passage opening of the second cooperating component.

2. The sealing element of claim 1, at least one of the first sealing component and the second sealing component further comprising a foam base layer interposed between the at least one of the first magnetic layer and the second magnetic layer and a respective one of the first cooperating component and the second cooperating component.

3. The sealing element of claim 1, at least one edge of the first sealing component and the second sealing component being beveled.

4. The sealing element of claim 1, the first cooperating component being a trickle duct component and the second cooperating component being a developer component in an image forming device.

5. The sealing element of claim 4, the first sealing component and the second sealing component cooperating to form the magnetically sealed material passage for the transport of charged toner particles between the trickle duct component and the developer component.

6. The sealing element of claim 5, further comprising magnetic particles interspersed between the first sealing component and the second sealing component to facilitate sealing in a direction therebetween.

7. A material transport system, comprising:

a first material transport component having a first material passage opening;

a first sealing component that is at least one of formed on and fixed to the first material transport component to surround the first material passage opening, the first sealing component being a first thin magnetic layer;

a second material transport component having a second material passage opening; and a second sealing component that is at least one of formed on and fixed to the second material transport component to surround the second material passage opening, the second sealing component comprising a second thin magnetic layer;

the first thin magnetic layer and the second thin magnetic layer each comprising a plurality of magnetic poles that are aligned to form a magnetically sealed material passage in a form of a conduit between the first material passage opening of the first material transport component and the second material passage opening of the second material transport component.

8. The material transport system of claim 7, at least one of the first sealing component and the second sealing component further comprising a foam base layer interposed between the at least one of the first thin magnetic layer and the second thin magnetic layer and a respective one of the first material transport component and the second material transport component.

9. The material transport system of claim 7, at least one edge of the first sealing component and the second sealing component being beveled.

10. The material transport system of claim 7, the first material transport component being a trickle duct component and the second material transport component being a developer component in an image forming device.

11. The material transport system of claim 10, the first sealing component and the second sealing component cooperating to form the magnetically sealed material passage for the transport of charged toner particles between the trickle duct component and the developer component.

12. The material transport system of claim 11, further comprising magnetic particles interspersed between the first sealing component and the second sealing component to facilitate sealing in a direction therebetween.

13. An image forming system, comprising:

a marking material source;

a marking engine for depositing marking material on an image receiving media substrate; and a plurality of material transport components forming a transport path for transporting the marking material from the marking material source to the marking engine, the plurality of material transport components comprising:

a first material transport component having a first material passage opening;

a first sealing component that is at least one of formed on and fixed to the first material transport component to surround the first material passage opening, the first sealing component being a first thin magnetic layer;

a second material transport component having a second material passage opening; and a second sealing component that is at least one of formed on and fixed to the second material transport component to surround the second material passage opening, the second sealing component comprising a second thin magnetic layer;

the first thin magnetic layer and the second thin magnetic layer each comprising a plurality of magnetic poles that are aligned to form a magnetically sealed material passage in a form of a conduit between the first material passage opening of the first material transport component and the second material passage opening of the second material transport component.

14. The image forming system of claim 13, at least one of the first sealing component and the second sealing component further comprising a foam base layer interposed between the at least one of the first thin magnetic layer and the second thin magnetic layer and a respective one of the first material transport component and the second material transport component.

15. The image forming system of claim 13, at least one edge of the first sealing component and the second sealing component being beveled.

16. The image forming system of claim 13, the first material transport component being a trickle duct component and the second material transport component being a developer component.

17. The image forming system of claim 16, the first sealing component and the second sealing component cooperating to form the magnetically sealed material passage for the transport of charged toner particles between the trickle duct component and the developer component.

18. The image forming system of claim 17, further comprising magnetic particles interspersed between the first sealing component and the second sealing component to facilitate sealing in a direction therebetween.

* * * * *